US010529312B1

(12) United States Patent
Adams et al.

(10) Patent No.: US 10,529,312 B1
(45) Date of Patent: Jan. 7, 2020

(54) SYSTEM AND METHOD FOR DELIVERING DYNAMIC USER-CONTROLLED MUSICAL ACCOMPANIMENTS

(71) Applicant: Appcompanist, LLC, New York, NY (US)

(72) Inventors: Darin Adams, New York, NY (US); Christopher Deppe, Kensington, CA (US)

(73) Assignee: APPCOMPANIST, LLC, New York, NY (US)

( * ) Notice: Subject to any disclaimer, the term of this patent is extended or adjusted under 35 U.S.C. 154(b) by 0 days.

(21) Appl. No.: 16/457,546

(22) Filed: Jun. 28, 2019

Related U.S. Application Data

(60) Provisional application No. 62/789,131, filed on Jan. 7, 2019.

(51) Int. Cl.
*G10H 1/36* (2006.01)
*G10H 1/40* (2006.01)

(52) U.S. Cl.
CPC ..... *G10H 1/366* (2013.01); *G10H 1/40* (2013.01); *G10H 2210/005* (2013.01); *G10H 2220/101* (2013.01)

(58) Field of Classification Search
CPC .... G10H 1/366; G10H 1/40; G10H 2220/101; G10H 2210/005
USPC ..... 84/609, 612, 636, 652
See application file for complete search history.

(56) References Cited

U.S. PATENT DOCUMENTS 5,391,828 A * 2/1995 Tajima ..... G10H 1/0016 84/464 R
8,847,053 B2 * 9/2014 Humphrey ..... G09B 5/065 84/609
2002/0134219 A1 * 9/2002 Aoki ..... G10H 1/0025 84/609
2007/0144334 A1 * 6/2007 Kashioka ..... G10G 1/00 84/612
2008/0013757 A1 * 1/2008 Carrier ..... G10H 1/0008 381/119
2013/0266155 A1 * 10/2013 Mashita ..... H04R 3/00 381/119
2014/0033903 A1 * 2/2014 Araki ..... G10G 1/00 84/612
2015/0147042 A1 * 5/2015 Miyahara ..... G11B 27/005 386/224
2017/0243506 A1 * 8/2017 Bayadzhan ..... G10H 1/0008

FOREIGN PATENT DOCUMENTS

WO 1994028539 A2 12/1994
WO 2003009295 A1 1/2003

* cited by examiner

*Primary Examiner* — Jeffrey Donels
(74) *Attorney, Agent, or Firm* — Brian R. Galvin; Galvin Patent Law, LLC

(57) ABSTRACT

A system and method for delivering dynamic user-controlled musical accompaniments, utilizing a computing device with a graphical user interface, an application running on said device, optionally using peripheral external or integrated devices, and a variety of controls to dynamically alter the playback of a pre-recorded accompaniment track, saving the altered accompaniment track for later use, and for sharing with other users via a cloud service engine, if desired.

16 Claims, 16 Drawing Sheets

SYSTEM AND METHOD FOR DELIVERING DYNAMIC USER-CONTROLLED MUSICAL ACCOMPANIMENTS

CROSS-REFERENCE TO RELATED APPLICATIONS

Current application date filed herewith Jan. 7, 2019 title LARGE SCALE RADIO FREQUENCY SIGNAL INFORMATION PROCESSING AND ANALYSIS SYSTEM which claims benefit of and priority to Ser. No. 62/789,131 Method for Recording, Delivering and Customizing Playback of Musical Accompaniments the entire specification of each of which is incorporated herein by reference.

BACKGROUND OF THE INVENTION

Field of the Art

The disclosure relates to the field of audio recording software, more specifically to the field of voice accompaniment and playback customization computer systems.

Discussion of the State of the Art

Professional singers and singers in training rely on live accompanists (typically piano players) or recorded accompaniments to provide musical support for their singing. They communicate the musical changes they desire while singing (speed up, slow down, hold and wait, etc.) to the live accompanists via gestures or looks or indications within their singing. They do not have that luxury with recorded accompaniments, so they simply try to follow what they hear, but with less than desirable accuracy or musicality. In some situations, a mentor or singing teacher may play an accompaniment while teaching, or record a version within the lesson for the student to use later in practice. But in all these situations, the services of the live accompanist are very expensive, and the recorded substitutes do not give the singer the necessary control to fine tune their interpretation of the song.

What is needed is a system and method for delivering dynamic user-controlled musical accompaniments.

SUMMARY OF THE INVENTION

According to a preferred embodiment, a system for delivering user-controlled musical accompaniments is disclosed, comprising: an accompaniment application comprising at least first plurality of programming instructions stored in a first memory and operating on a first processor, wherein the first plurality of programming instructions, when operating on the first processor, cause the first processor to: receive accompaniment music in music information format comprising musical notes and a first tempo; allow a user to initiate a first playback of the accompaniment music at the first tempo using a graphical user interface; provide one or more controls on the graphical user interface for the user to control one or more aspects of the playback of the accompaniment music in real time; wherein the one or more controls comprise a fermata button which, when pressed during playback of the accompaniment music, causes the first processor to: set a second music tempo to at most $1/10^{th}$ of the first tempo; continue to sound currently audible notes at the second music tempo while the fermata button is being held; and wherein the release of the fermata button causes the processor to: identify all audio events in the accompaniment music from the current play position to the next note in the accompaniment track; implement each identified audio event in sequence; resume playback at the next note in the accompaniment track at the first tempo.

According to another preferred embodiment, a method for delivering user-controlled musical accompaniments is disclosed, comprising the steps of: receiving accompaniment music in music information format comprising musical notes; allowing a user to initiate a first playback of the accompaniment music at a first tempo using a graphical user interface; providing one or more controls on the graphical user interface for the user to control one or more aspects of the playback of the accompaniment music in real time; wherein the one or more controls comprise a fermata button which, when pressed, causes a device playing back the accompaniment music to: set a second music tempo to at most $1/10^{th}$ of the first tempo; continue to sound currently audible notes at the second music tempo while the fermata button is being held; and wherein the release of the fermata button causes the device playing back the accompaniment music to: identify all audio events in the accompaniment music from the current play position to the next note in the accompaniment track; implement each identified audio event in sequence; resume playback at a next note in the accompaniment track at the first tempo.

According to an aspect of an embodiment, the one or more controls further comprise a set marker button which, when pressed, causes the processor to: record a location in the accompaniment music at which a marker should be set; and store a marker indicating that location.

According to an aspect of an embodiment, the fermata button, when pressed and then released while the accompaniment music is stopped, causes the processor to: identify all audio events in the accompaniment music from the current play position to the next note in the accompaniment track; implement each identified audio event in sequence; and start playback at the next note in the accompaniment track.

According to an aspect of an embodiment, the one or more controls further comprise a tempo slider which, when moved, causes the processor to: set a third music tempo to a value indicated on the tempo slider; continue playback of the accompaniment music at the third tempo, until the third tempo is canceled by the user; and resume playback of the accompaniment music at the first tempo when the third tempo is canceled by the user.

According to an aspect of an embodiment, the accompaniment application further allows the user to create customized versions of the accompaniment music by: saving playback alterations to the accompaniment music made by the user; allowing the user to play back a customized version of the accompaniment music file, comprising the accompaniment music as altered by the playback alterations; and allowing the user to override the playback alterations during playback of the customized version of the accompaniment music by using the one or more controls on the graphical user interface.

According to an aspect of an embodiment, the system further comprises a cloud service engine comprising at least a second processor, a second memory, and a second plurality of programming instructions stored in the second memory and operating on the second processor, wherein the second programming instructions, when operating on the second processor, cause the second processor to: communicate with the accompaniment application; send to, and receive from, the accompaniment application data comprising accompaniment music and playback alterations to the accompaniment music; display, and allow selection of, stored files by the accompaniment application; display, and allow selection of, privacy settings for files uploaded by the accompaniment application; and allow sharing of, or sale of, files to other instances of the accompaniment application owned by other users.

According to an aspect of an embodiment, peripheral devices are used instead of, or in addition to, one or more of the controls on the graphical user interface to control playback of the accompaniment music.

According to an aspect of an embodiment, the one or more controls further comprise a melody blend slider which, when moved, causes the processor to: select a melody track within the accompaniment music; and adjust the relative volume of the melody track and volume of the accompaniment music without stopping playback of the accompaniment music.

BRIEF DESCRIPTION OF THE DRAWING FIGURES

The accompanying drawings illustrate several aspects and, together with the description, serve to explain the principles of the invention according to the aspects. It will be appreciated by one skilled in the art that the particular arrangements illustrated in the drawings are merely exemplary, and are not to be considered as limiting of the scope of the invention or the claims herein in any way.

DETAILED DESCRIPTION

Figure 1:
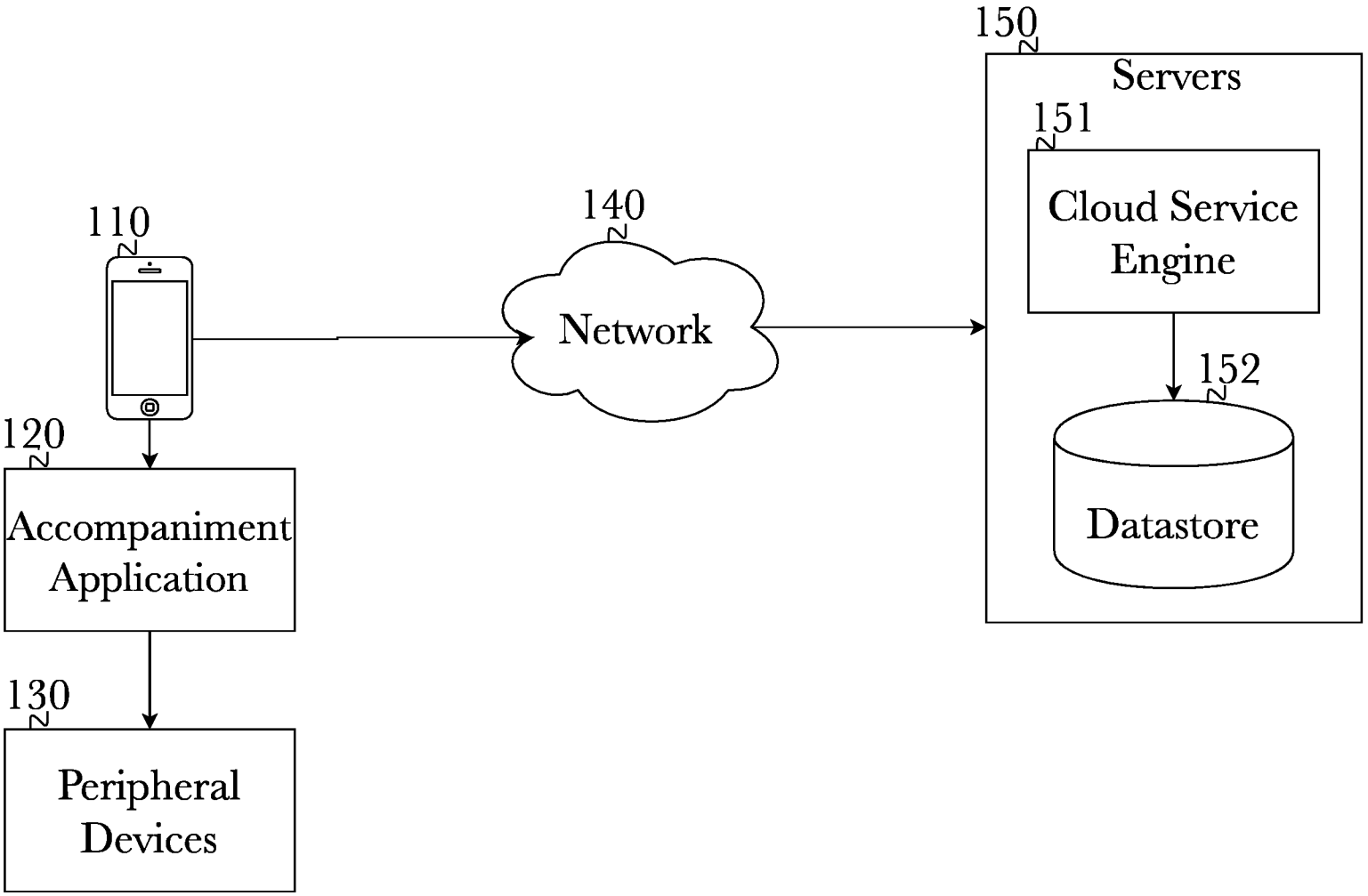
FIG. 1 is a system diagram illustrating connections between key components in the function of a dynamic user-controlled music accompaniment system, according to a preferred embodiment.

The inventor has conceived, and reduced to practice, a system and method for delivering dynamic user-controlled musical accompaniments.

Definitions

"Audio format" as used herein means a file or track containing a representation of music as a sound wave. Audio files may be analog or digital, but are more commonly digital in modern technology. Digital audio files are digital representations of the original sound wave, and may be encoded into a variety of formats such as WAV, AIFF, AU, PCM, MPEG-4, WMA, and MP3.

"Audio event" as used herein means information in a music information format file other than note information that directs a change in the music information being played. For example, MIDI channel messages directing pedal commands, patch changes, pitch bends, and similar events are audio events.

"Music information format" as used herein means a file or track containing a representation of music as information about the notes being played, such as the pitch, duration, volume, and timing of each note, and may include other information about the music being played, such as the tempo, the instrument or instruments on which the music is being played, etc. The most common form of note information files in Musical Instrument Digital Information (MIDI) format. A music information format file may contain multiple tracks, each containing different music information. For example, tracks may be divided according to the type of instruments playing, or tracks may be divided by the type of musical parts or purpose (e.g., an accompaniment track might contain a certain version of the music, while a melody track contains another version). Tracks may be played separately or in any combination.

"Thread" as used herein means an execution thread of a software application which is assigned an operational task on the computer. Threads are managed by the computer's operating system, and can be run simultaneously with other threads performing different operations.

"Thread lock" means an operating system kernel level protection to ensure that only one thread at a time has access to certain resources in order to prevent overlapping or conflicting access to a resource by different threads. In some operating systems, a thread lock is referred to as "mutex," meaning "mutual exclusion." Thread locks have many implementations, such as binary semaphores, spinlocks, condition locks, and ticket locks, which use thread locks in various ways to retain exclusivity of access for certain times or under certain conditions.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

According to an embodiment, an application on a handheld device exists that could enable a user to select a file from a multitude of music files and personalize it for use during singing or playing. Such an application offers the use of a fermata option, enabling the user to hold the playback for as long as needed, with held notes sustaining and decaying naturally, as would happen with a real-life accompanist, and then upon release the accompaniment starts immediately at the next note of the accompaniment and plays on. This fermata option may be implemented in the form of a button or active area on the screen of the mobile device, or a button on a wired or wireless peripheral device programmed to act as the fermata function.

The application may also offer a slider, either on the screen or on a physical accessory device, that enables dynamic movement and change of the playback speed (tempo) at any time to faster or slower speed as the piece plays. The speed may be instantaneously reset to the default speed of the selected music file, or instantaneously reset to another default speed as set by the user during play. By similar physical or logical means, a user may change the playback pitch or key to higher or lower pitch or key, and in some cases the music file may continue from that point onward in the new pitch. By similar physical or logical means, a user may adjust the melody blend, that is, the mixture of volume between the separate melody and accompaniment tracks, to raise or lower the volume of the melody line; and the user by similar means may reset the blend to the default blend of the piece currently playing. This melody blend feature allows users to bring in one or more melody lines at a volume proportion of their choosing relative to the volume of the accompaniment, and adjust that proportion as needed at any time during play. Users can turn the melody on or off without stopping play, and then use the slider or sliders to choose to hear the melody line of various parts emphasized in a variety of octaves or instrument sounds to aid in learning.

In some embodiments, a user may save customizations of accompaniment music files locally on a computing device for later access. In networked embodiments, a user may save all the customizations of the selected music files and have access to them on any subscribed computing device for later play, and then the user may share a saved version with comments with other users. Further, another user could comment back to a sharing user a review or suggestion on a shared customization. Also, a user could make an audio recording of his voice in a separate track alongside a newly recorded audio track from the user-controlled audio recording and share that new audio recording of voice and piano together through the system or save that recording outside the system. The user could add reverb to the vocal track, adjust the volume mix between voice and piano, and select different piano sounds. Similarly, a user could also create a video recording, with reverb option for sound. The user would then have options to set the volume mix between voice and piano, select different piano sounds, and share that video through the system or save that video recording outside the system.

Vocal exercises could also be offered within the app in such a way that the user controls which direction (up or down in pitch) the repeated patterns or scales move. Direction changes could be made by the user during play to facilitate a continuous warm-up or exercise routine. The user could also decide to "skip" up with the repeated scale or pattern by any number of half-steps. Vocal exercises can also be played at any tempo without musical distortion or degradation.

A choral version of the device could also be introduced in which multiple melody lines can be emphasized or blended against the accompaniment at their own volume levels such that an eight-part choral piece (SSAATTBB, letters indicating the eight parts or divisi, here as two each soprano, alto, tenor, and bass) could be played through the app with all of the other play features described herein, but also allow the Soprano 1 line to be louder in relation to the accompaniment than the rest of the parts. Or the 1$^{st}$ tenors and baritones could hear their lines emphasized together above the volume of the other parts and the accompaniment. This choral version can also be used to facilitate duets, trios, quartets, quintets and other ensemble pieces to be practiced and learned using the app.

In some cases, a system may collect many MIDI files, or audio recordings converted to suitable MIDI files, from various sources, each file typically containing at least one pair of tracks, typically one for accompaniment (usually a pianist) and one for melody line, as played by instrument or piano, playing what is written to be performed by a singer or solo instrumentalist. These files may then be made available in a server or a cloud so a user could play them on a handheld device, for practice and even for performance.

Various embodiments of the present disclosure may be implemented in computer hardware, firmware, software, and/or combinations thereof. Methods of the present disclosure can be implemented via computer program instructions stored on one or more non-transitory computer-readable storage devices for execution by a processor. Likewise, various processes (or portions thereof) of the present disclosure can be performed by a processor executing computer program instructions. Embodiments of the present disclosure may be implemented via one or more computer programs that are executable on a computer system including at least one processor coupled to receive data and instructions from, and to transmit data and instructions to, a data storage system, at least one input device, and at least one output device. Each computer program can be implemented in any suitable manner, including via a high-level procedural or object-oriented programming language and/or via assembly or machine language. Systems of the present disclosure may include, by way of example, both general and special purpose microprocessors which may retrieve instructions and data to and from various types of volatile and/or non-volatile memory. Computer systems operating in conjunction with the embodiments of the present disclosure may include one or more mass storage devices for storing data files, which may include: magnetic disks, such as internal hard disks and removable disks; magneto-optical disks; and optical disks. Storage devices suitable for tangibly embodying computer program instructions and data (also called the "non-transitory computer-readable storage media") include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits) and other forms of hardware.

In some cases, recordings are made or commissioned to be made in MIDI format directly. In other cases, recordings are made as audio recordings in other formats, which can be converted to MIDI format later, or some other suitable audio format, which may change depending on the current state of the art. Although conversion of audio recordings to MIDI is less desirable because it is less accurate, it allows for older recordings to be utilized, using an audio conversion engine in the system. The MIDI recordings or conversion can be done with many software tools if not a custom-built audio-conversion engine, including but not limited to, for example, PROLOGIC™, ABLETON™, CUBASE™ and CAKEWALK™. Typically, at least two tracks may be recorded, one for the accompaniment, and one separate for the melody, so they can be played back separately or combined.

In some cases of a user making an audio recording, the user can add reverb to the vocal track, adjust the volume mix between voice and piano, and select different piano sounds. A video recording option may also be implemented with the same mixing and sharing options as above. Additionally, a "vamp" feature could be added that would enable the user to press and hold a button similar to fermata while piece is playing—whatever segment of the accompaniment plays while the button is held will be labeled as a vamp. Then in future play, a user can press a button during that part of the accompaniment playback to loop that selected segment as many times as desired. Similarly, an Edit Features button could be added to allow users to tap a Marker button at any time during the playback of a recording to add a marker at that specific time stamp in the recording. Markers could then be used to navigate immediately to that point in the recording with forward or back arrows that appear to the right and left of the play icon. Also, users could choose to create a "cut" or "loop" section between any two markers or between the beginning of the recording and a marker or a marker and the end of the recording.

In some cases, a system may collect many audio files, or audio recordings converted to suitable audio files, from various sources, each file containing at least one pair of tracks, typically one for accompaniment (usually a pianist) and one for melody line, as played by instrument or piano, playing what is written to be performed by a singer or solo instrumentalist. These files may then be made available in a server or a cloud so a user could play them on a handheld device, for practice and even for performance.

A marketplace system operating on a server across a network, with a cloud services engine to operate the marketplace and social media systems required, may exist, for the purpose of allowing users to browse and search for audio files to utilize with the audio accompaniment application. A social media system, similarly but independently from a marketplace system, may exist, for the purpose of sharing and commenting on other user's audio files, provided a user's privacy settings allow for such.

Conceptual Architecture

FIG. 1 is a system diagram illustrating connections between key components in the function of a dynamic user-controlled music accompaniment system, according to a preferred embodiment. A smartphone device 110 operates an accompaniment application 120, which is a software application designed to aid vocal and choral performers in the use of pre-recorded accompaniment tracks to a greater degree of specificity, complexity, and customization than is normally possible, to emulate the effect of having an actual live accompanist present. Peripheral devices 130 including but not limited to foot pedals, exterior buttons that may be connected either via a wire or some wireless connection, or other peripheral devices, may also be connected to the application 120, allowing for more customization of the user interface, and a more "natural" use of the application. For example, foot pedals are commonly used in various performing arts including electric guitar playing, keyboard or piano playing, and it is sometimes the case that choral performers or vocal soloists may use subtle signs with their feet or hands to indicate changes in the way the accompanying instruments are playing, and peripheral devices may be used to more naturally emulate this ability for a pre-recorded accompaniment. A phone 110 operating an accompaniment application 120 may also be connected to a network 140, such as the Internet, which connects to at least one server 150 but potentially a plurality of servers, operating a cloud service engine 151 which connects to an internal datastore 152. Such servers may synchronize their internal datastores 152 with each other, or may operate independently, depending on a specific implementation of the system. A cloud service engine 151 may operate a marketplace engine 250 and social media engine 260, as illustrated in FIG. 2, for communication with a phone 110 operating an accompaniment application 120, and providing extended functionality, but it is possible to operate an accompaniment application 120 without a phone 110 being connected to any servers 150, provided no new data is required to download for the application.

Figure 2:
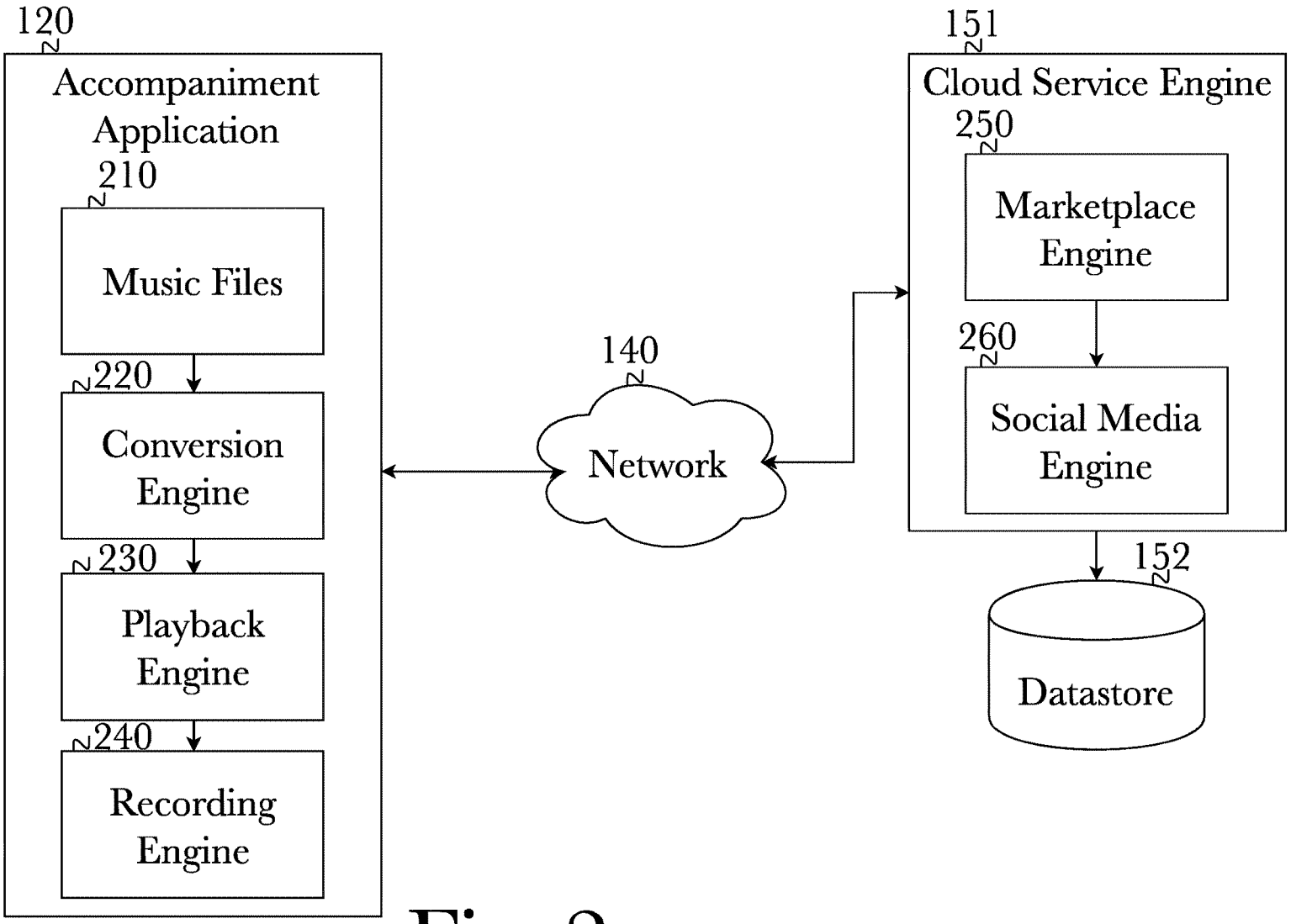
FIG. 2 is a system diagram illustrating components and connections between components in the operation of a pre-recorded vocal accompaniment application on a phone, connecting to cloud services.

FIG. 2 is a system diagram illustrating components and connections between components in the operation of a pre-recorded vocal accompaniment application 120 on a phone 110, connecting to cloud services. An accompaniment application 120 contains as part of its operation, music files 210, a conversion engine 220, a playback engine 230, and a recording engine 240, and maintains an application-specific connection over a network 140 to servers operating a cloud services engine 151 operating at least a marketplace engine 250 and social media engine 260, said cloud services 151 communicating with a datastore 152. Music files 210 as utilized by an accompaniment application 120 may be of any format, including MIDI, mp3, or other audio file and music information formats, so long as they are a recognized format, such that a conversion engine 220 may be able to convert them to a MIDI file, or other appropriate file format. A playback engine 230 plays such converted and therefore appropriately formatted audio files back to a user, in a manner which allows buttons and peripheral devices 130 to alter the playback of said audio files. Such buttons may be touch-screen enabled buttons similar to many smartphone applications currently in use, and include, at least, a fermata button for sustaining a held note, a tempo slider for altering the playback speed for an audio file, a pitch slider to alter the relative pitch of an audio file being played, a volume slider to alter the volume mix of a melody track relative to an accompaniment track, and a button to allow a user to specify a cut or mark in the track to be repeated or return to in a similar manner to a bookmark in the playback of the audio file. Functionality of such application features is illustrated more clearly in FIG. 4. A recording engine 240 which may record a version of the accompaniment track, that preserves any customization or alterations made by a user utilizing the functionality of the playback engine 230, and may record a user's vocal performance utilizing a microphone present in a smartphone 110 or used as a peripheral device 130 in case a third-party microphone is utilized. Video recording is also possible with a recording engine, again utilizing either a camera on a smartphone 110 or a separate camera peripheral 130, for the purpose of recording a user's performance during playback of an accompaniment track. A cloud service engine 151 contains components including a marketplace engine 250, which may communicate with a datastore 152 to serve an application 120 stored accompaniment tracks according to a search query 510 as illustrated in FIG. 5, and may also allow for the selling or purchasing or tracks recorded from an accompaniment application 120 via the customization or performance of a user of said application. A social media engine 260 may also allow the sharing of such recorded tracks with other users, and may also allow commenting on such recorded files or tracks by other users, depending on the privacy settings of the owning user. Such transactions, shares, comments, and settings are stored in a datastore 152.

Figure 3:
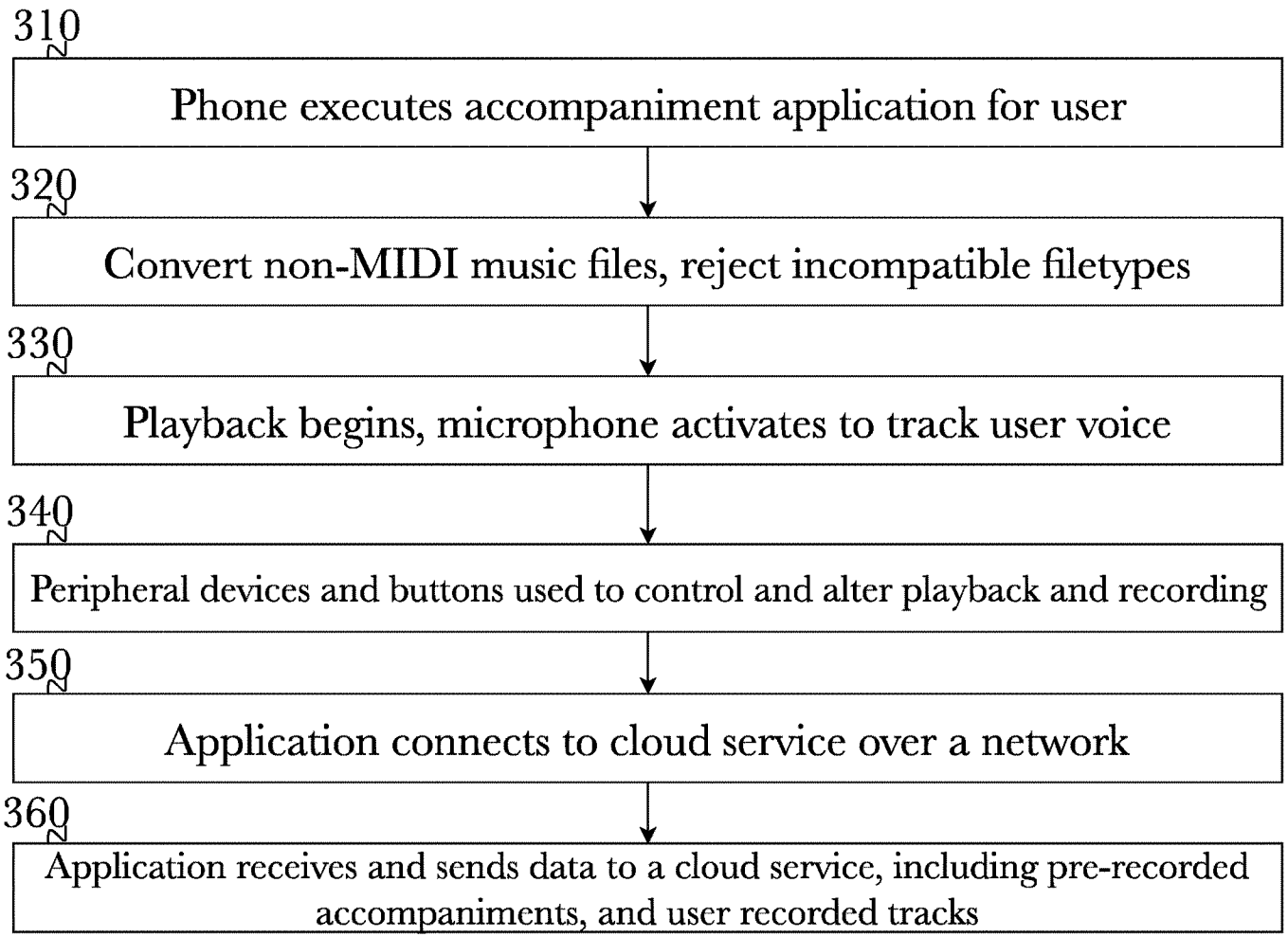
FIG. 3 is a method diagram illustrating core functionality of a phone operating a dynamic, modular vocal accompaniment application, and communicating with network-enabled resources including a cloud service engine, according to a preferred aspect.

FIG. 3 is a method diagram illustrating core functionality of a phone operating a dynamic, modular vocal accompaniment application, and communicating with network-enabled resources including a cloud service engine, according to a preferred aspect. First, a phone must execute the accompaniment application 120, 310. When the application is running, non-MIDI files of compatible file format types, such as mp3 or other formats, may be converted to appropriate MIDI files 320, while valid MIDI files remain, ready for playback and customization. Playback may begin when a MIDI file is present and selected by the user 330, with the microphone peripheral 130 or built-in microphone of a phone 110 activating to track the user's voice 330 during their practice or performance. Recording of a user's voice is placed in a separate track to the recorded tracks of the dynamically altered MIDI accompaniment recording, and both are saved and able to be modified or uploaded at a later date, if desired. Peripheral devices and buttons, or only one of the two, may further be used to customize the playback of an accompaniment track 340, which is recorded as an altered track, allowing a user to save their modified track, close the application, and continue from where they left off later upon re-opening the application. Alternatively, after connecting to a cloud service 151 operating on a network-enabled 140 server 150, 350, such saved altered tracks, as well as a user's own vocal performance and optional video recording, may be uploaded to the cloud service 360.

Figure 4:
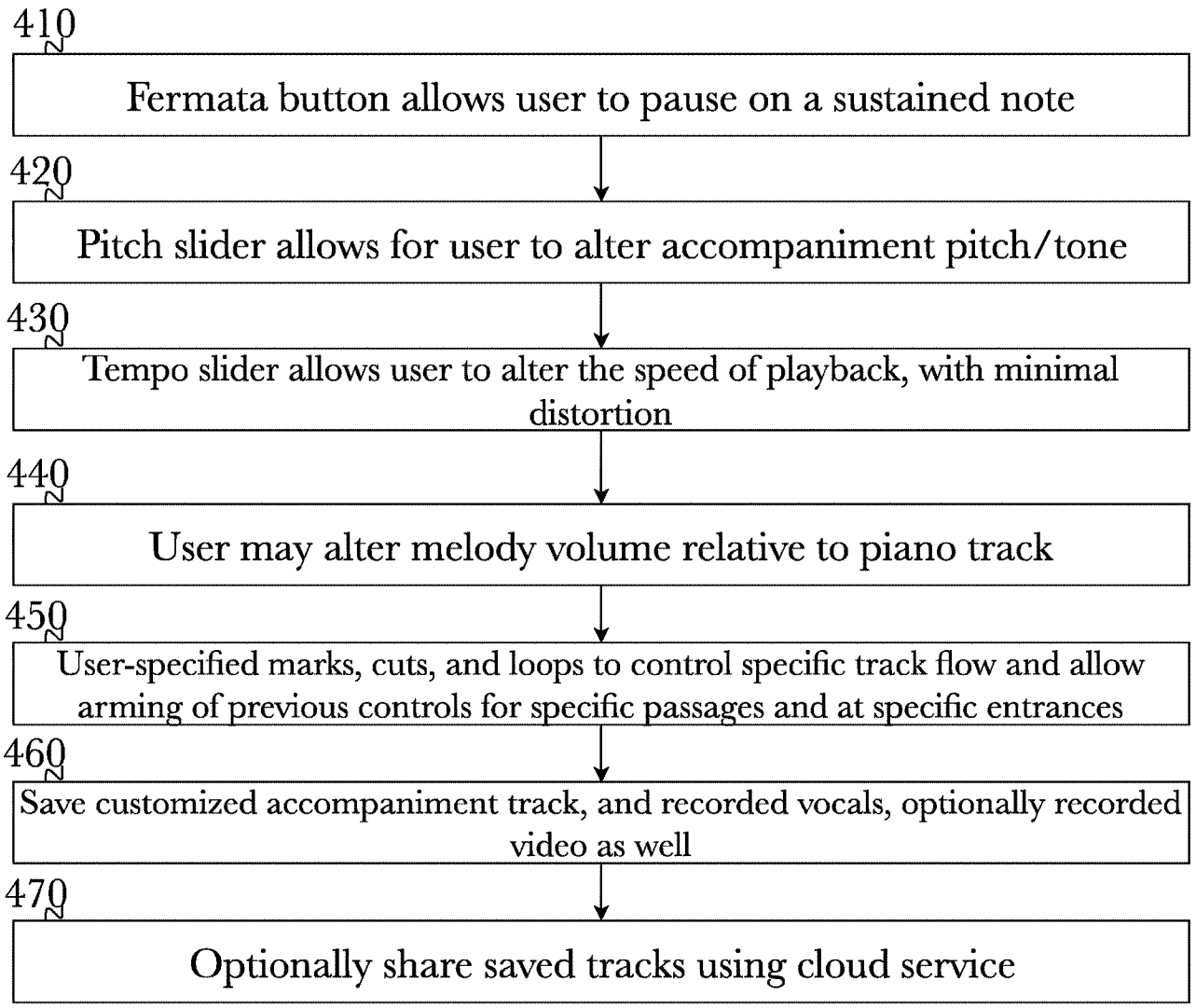
FIG. 4 is a method diagram illustrating functionality of a dynamic, modular accompaniment application, according to a preferred aspect.
Figure 5:
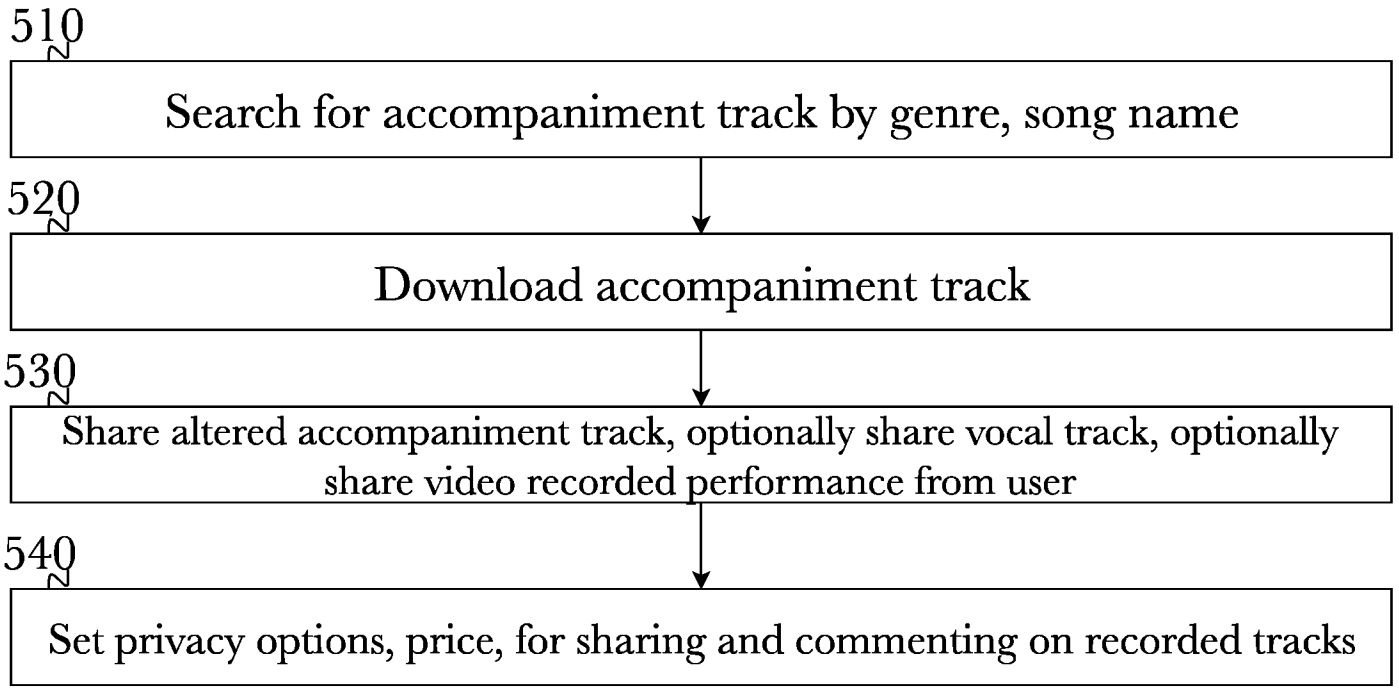
FIG. 5 is a method diagram illustrating functionality of a network-enabled cloud service engine, according to a preferred aspect.

FIG. 4 is a method diagram illustrating functionality of a dynamic, modular accompaniment application, according to a preferred aspect. A fermata button 410 may be utilized by a user to sustain a note or chord, similar to a musician holding a note on their instrument until instructed otherwise, as long as the application user holds down the button. This may be utilized with a peripheral device such as a foot pedal, or an on-screen button on a smartphone touchscreen. Another function allowing user customization of pre-recorded accompaniment track playback is a touchscreen slider allowing alteration of the pitch of the audio playback 420, which also may be controlled with a peripheral device 130 if desired. Such peripherals may include turning knobs on a control panel of some variety, for example, but may include any other compatible device capable of connecting to the smartphone. The pitch and therefore tone of the playback may be altered in this way 420. Another function allowing user customization of pre-recorded accompaniment track playback is a touchscreen slider allowing alteration of the playback tempo, with minimal or no distortion 430, merely altering the speed at which notes or chords are sustained, and the speed at which further notes or chords are played afterwards. Another function allowing user customization of pre-recorded accompaniment track playback is a slider allowing a user to alter the relative volume of the melody track to the piano accompaniment 440, or other instrument accompaniment track, within the MIDI audio file playback, allowing for louder or softer melody relative to the volume of the accompaniment. Another function allowing user customization of pre-recorded accompaniment track playback is the use of user-placed and specified marks, or cuts, or loop segments, allowing a user to place what are essentially "bookmarks" in the file's playback, while also allowing for users to repeat or "loop" specific passages in the track 450, also allowing a user to enter into a specific passage or begin a new track with a "fermata start" functionality if desired, whereby the next note after the mark (or the first start after the beginning of a track) is held, for the simulation of a cold opening for performers to practice with 450. After alterations and customizations to audio playback have been made, the customized accompaniment track, as well as the user's vocal performance and optionally video recording, the tracks are saved 460, which may be accessed by the user at a later time for continued customization or re-recording their performance, or simply reviewing their performance, and may also be uploaded to a cloud service 151, 470 for sale or sharing with a marketplace engine 250 or social media engine 260.

FIG. 5 is a method diagram illustrating functionality of a network-enabled cloud service engine, according to a preferred aspect. A user may search for an accompaniment track by either, or both, genre and track name 510, utilizing a connection between a phone 110 and accompaniment app 120 and the marketplace engine 250 operating on a network 140 enabled server 150. A track may take the form of a MIDI file or a yet-unconverted audio file of some other recognized format. A user may then download the specified track 520, which, after utilizing and altering the track as an accompaniment as illustrated in FIG. 4, may be shared as an altered, customized track 530, with privacy settings, and a price if desired, being set 540 when shared to a marketplace engine 250 or social media engine 260. If available to another user via proper privacy and monetary settings, a user may share and/or comment on an uploaded track 540.

Figure 10:
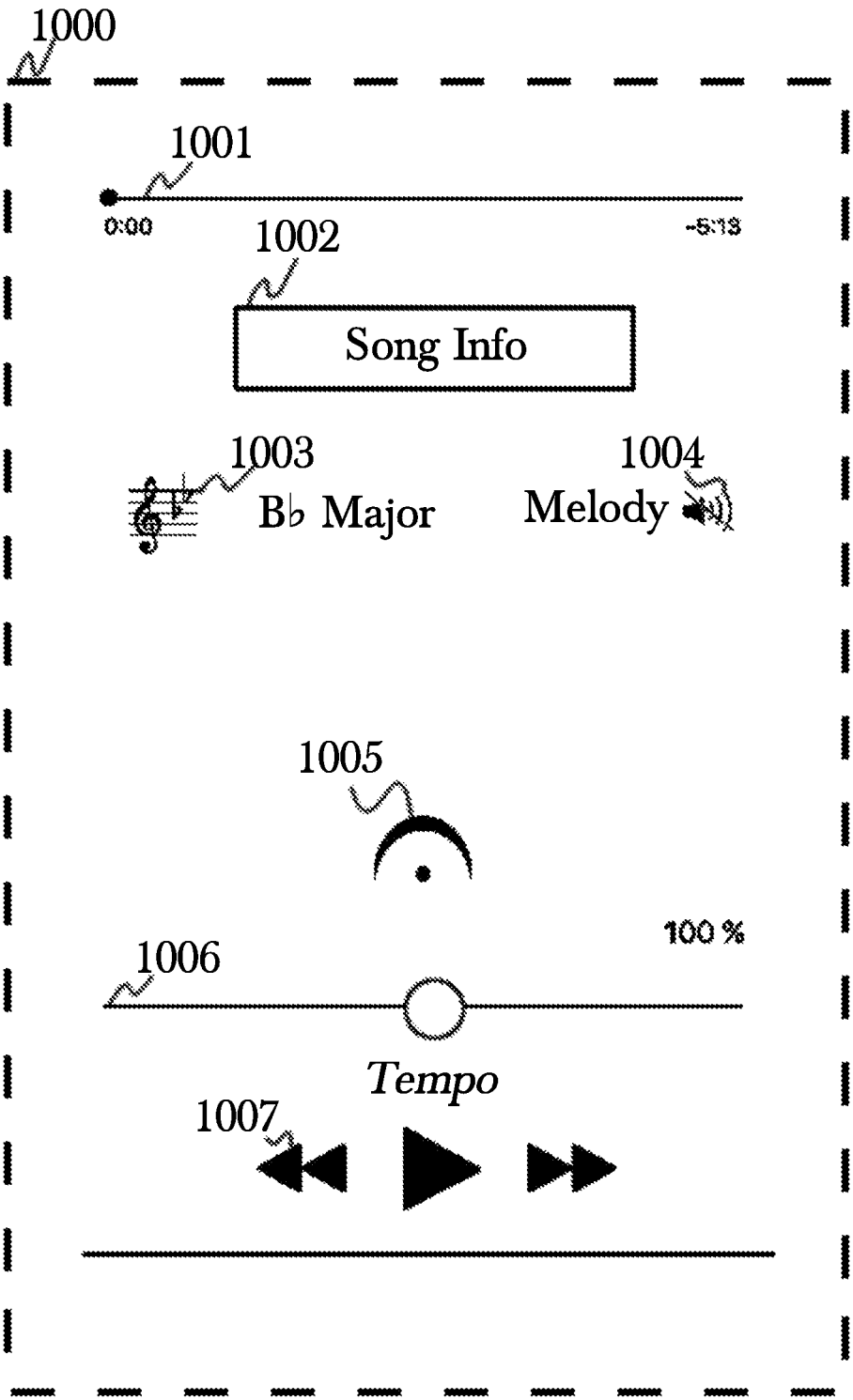
FIG. 10 shows an exemplary play screen, according to the system and method disclosed herein.

FIG. 10 shows an exemplary basic play screen 1000, according to the system and method disclosed herein. Screen features include a song timeline 1001; song title and other catalog information 1002; musical key of the song 1003; melody icon 1004, showing, in this case, that the song melody is suppressed; fermata (hold) symbol 1005; tempo slider 1006, shown here at 100 percent, with a slider to enable tempo adjustment; and play controls 1007, including play/pause, fast forward, and reverse.

Figure 11:
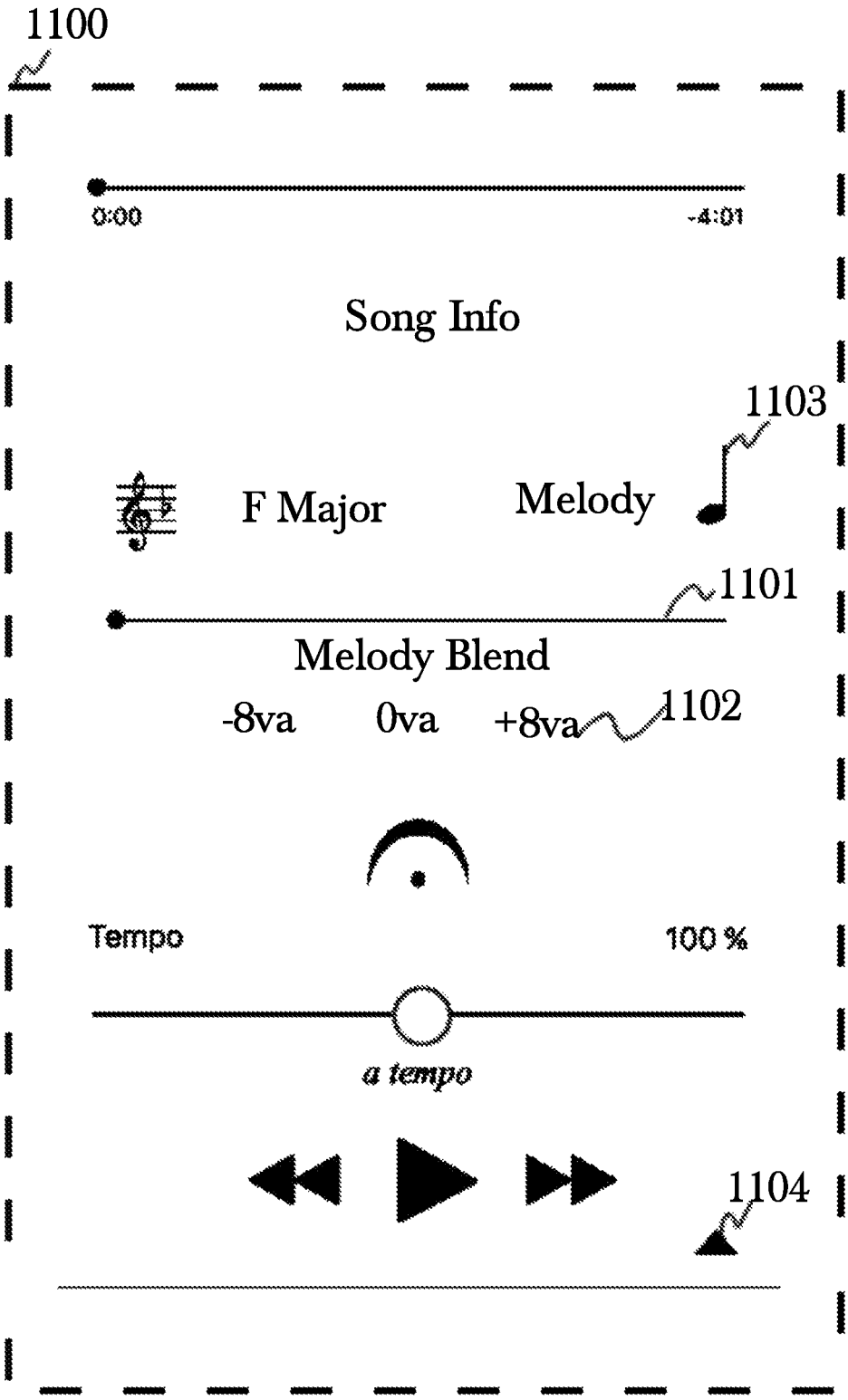
FIG. 11 shows another exemplary play screen, according to the system and method disclosed herein.

FIG. 11 shows another exemplary play screen 1100, according to the system and method disclosed herein. The Melody Blend feature is now activated, as indicated by the presence of the Melody Blend slider icon 1101 and the Octave Selection Buttons 1102. Users can now hear a melody guide track with the volume in varying proportions to the accompaniment, with the accompaniment music volume held constant, the melody music volume may be adjusted from 0% to 100% by adjusting the Melody Blend slider 1101 from left to right. Users may click icon 1103 any time the piece is stopped to hear the next melody note. Users can also choose one of three octaves in which the melody plays by clicking on one of the three octaves in the Octave Selection section 1102. The triangular button 1104 enables users to switch the audio playback to any available audio playback device, if they wish to, for example, connect via Wi-Fi or Bluetooth connection to a separate audio output device.

In some embodiments, the Melody Blend slider may operate with dual functionality as follows. The Melody Blend slider defaults to a position in the center of the slider. When the melody slider moves left of center, the melody track volume is decreased as the accompaniment volume is unaffected. Conversely, when the slider moves right of center the accompaniment volume is decreased as the melody volume is unaffected. In another embodiment, when the melody slider moves left of center, the melody track volume is decreased as the accompaniment volume is increased. Conversely, when the slider moves right of center the accompaniment volume is decreased as the melody volume is increased. The Melody Blend slider allows users to have full control of melody vs. accompaniment volume in a manner that is convenient and intuitive to use while singing or playing music. While playing with accompaniment, a musician (including vocalists) may want to hear only the melody line, or lots of melody against a reduced accompaniment volume. But there are also times you might want to be able to have just a faint melody playing with a full volume accompaniment. That's what the new blend proportions allow.

Figure 12:
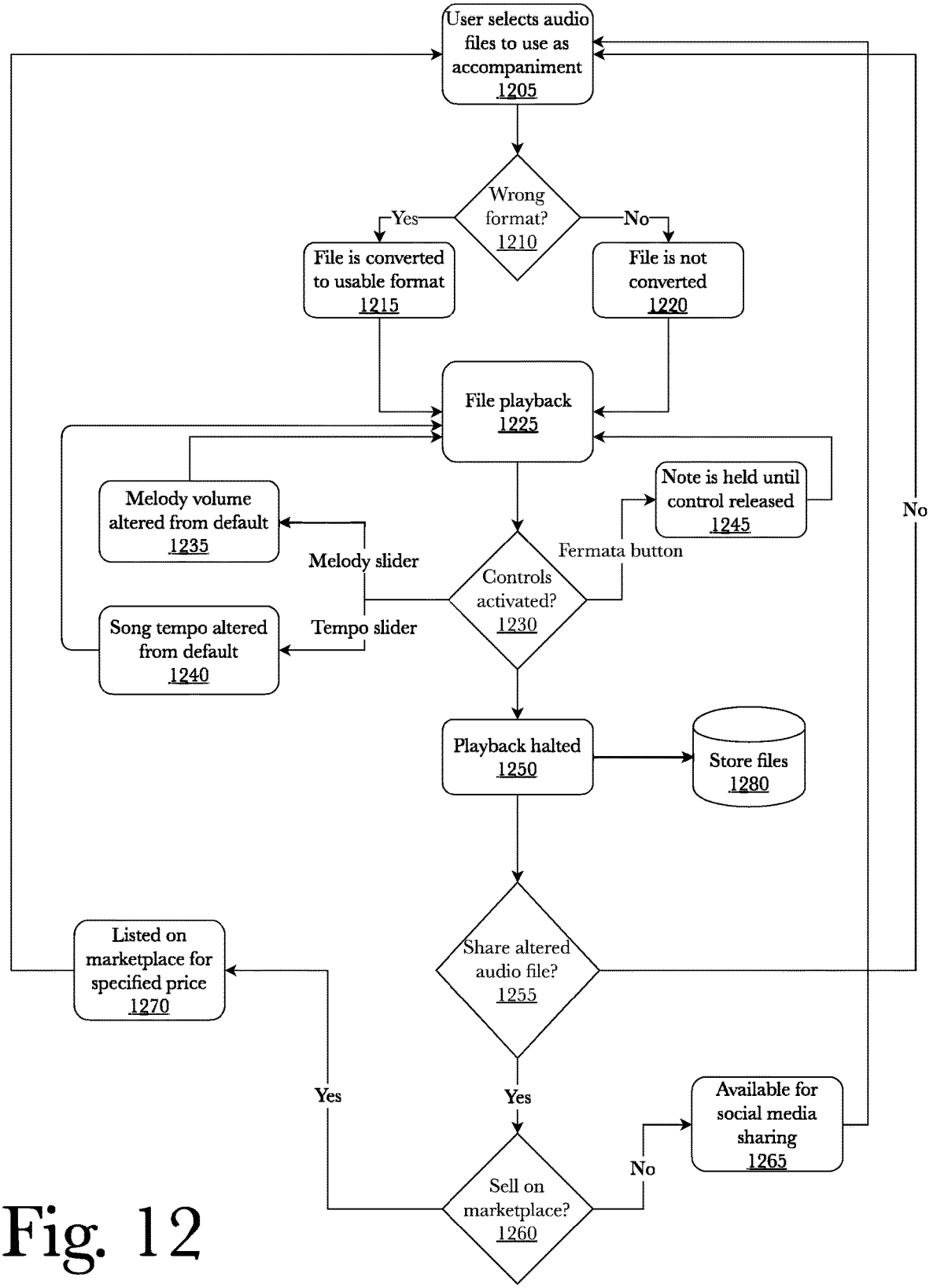
FIG. 12 is a flowchart illustrating the flow of data and functionality in the application, according to an embodiment.

FIG. 12 is a flowchart illustrating the flow of data and functionality in the application, according to an embodiment. First, a user must select at least one audio file to use as an accompaniment 1205, but may choose multiple files, if desired. MIDI files may be the desired format for some implementations, or some other audio file format may be used. If any file or files chosen by a user are not the correct format 1210, depending on what the "correct" format may be for a given implementation, then a file may either be converted to the appropriate format such as MIDI 1215, or remain unconverted 1220. At this point, audio playback commences 1225, until a user specifies otherwise, using one or more of the on-screen controls to alter the playback of the audio. If any controls are activated 1230, what occurs next depends on the specific control used. If a melody slider is used, the melody volume relative to the volume of other "tracks" in the audio file may be altered 1235. For example, it may be possible with the melody blend slider to have a louder melody track than accompaniment, or vice versa, for specific practice exercises or performance requirements. After melody volume alterations take place 1235, the flowchart refers back to playback 1225, but this is not to indicate that playback stopped, rather to indicate the place in the flowchart which represents what the next step may be for functionality to continue. Unless a user specifies or a file ends from being played to completion, audio playback does not interrupt or end. If an activated control 1230 is instead the tempo slider, which controls the speed and tempo at which the file plays, then the tempo of the file playback may be altered according to user specifications 1240. After tempo alterations are complete by the user, the flowchart refers back to playback 1225 and awaiting activation of other controls 1230. A further control a user may activate 1230 is a fermata button 1245 which may allow a user to hold the audio playback on a specific note that is played, like a pause button that continually plays the last fraction of a second of audio data while being paused. In this state, playback 1225 is paused until the user releases the fermata button 1245, unlike with other functionality such as the tempo slider or melody volume slider. When playback is halted 1250 through the use of an actual pause button, using a menu button to leave the playback engine, or the playback being complete due to the audio file ending, a user may choose whether to share the edited audio file they have created 1255, or not. In some embodiments, a playback execution thread or a playback monitoring thread may be blocked using a condition lock until playback is resumed. The system also stores the modified file 1280, for later use, such as re-opening the same accompaniment file, allowing a user to pick up where they left off. If a user chooses not to share the audio file with their alterations, they may simply save it and then select further audio files to play 1205. If a user does, however, wish to share the altered audio file they have constructed, they may then decide whether to sell it on a digital marketplace 1260. If a user chooses not to sell their altered audio file on the cloud marketplace provided, it may still be available for social media sharing and commenting 1265, but if they do wish to sell it on a cloud-engine enabled marketplace, it may be listed on the marketplace for a specified price 1270, before the application proceeds to allow a user to pick other files to begin playing 1205, as before.

Figure 13:
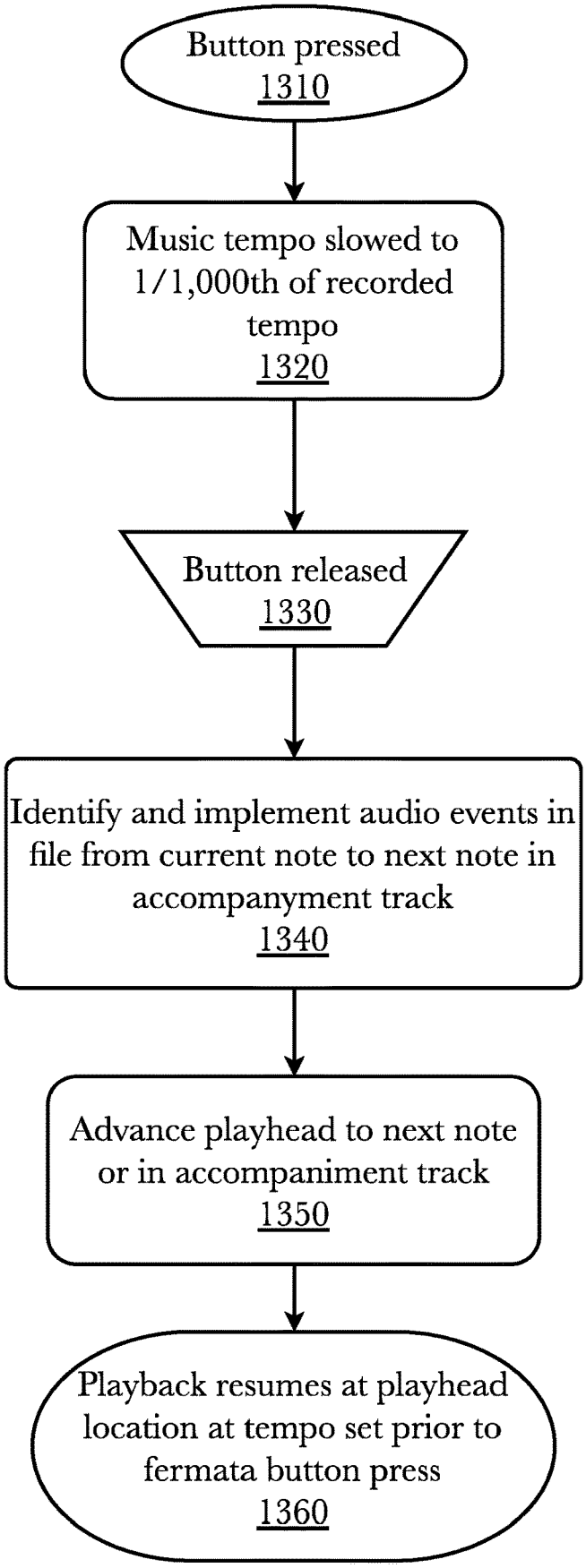
FIG. 13 is a flowchart illustrating the note holding functionality of a fermata button, according to an aspect of an embodiment.

FIG. 13 is a flowchart illustrating the note holding functionality of a fermata button, according to an aspect of an embodiment. While the accompaniment music is being played back, a user may press an on-screen button 1310, 1005, which, when held, causes accompaniment tempo to slow to $1/1000^{th}$ of the recorded or current tempo 1320, causing the current note to continue to be played at the same pitch and volume, but dramatically extending the duration of the note. In this way, the note is "held" as long as the fermata button is pressed. In some embodiments, even though the note is "held," the note may decay in real time (and not at $1/1000^{th}$ of the recorded or current tempo), as is the case with MIDI implementations of the accompaniment music. It should be noted that while the tempo is slowed in this embodiment to $1/1000^{th}$ of the current tempo, this ratio should not be considered limiting, and other embodiments may slow the tempo in different ratios. When the fermata button is released 1330, the application identifies audio events (e.g., pedal commands) from the currently playing note up to the next note in the accompaniment track 1340, gathering and reporting every MIDI audio event up to that point, which audio events are then sent on a command channel directly to the MIDI engine which implements each such audio event in sequence. In this way, before the playback begins next, the audio events including lingering note sounds, pedal effects, distortion, and more, are all still represented as evaluating in a smooth continuation of the audio state prior to interruption by the fermata button, and there is no "choppiness" from pausing to unpausing with the fermata button, providing for smooth playback. After this evaluation 1340, the playhead is advanced to the next note in the accompaniment track 1350 whereby playback continues at the tempo set prior to the fermata button press 1360. Although this example shows the audio events/pedal commands being performed before advancement of the playhead, an alternate embodiment would have the playhead advanced first, and then the audio events/pedal commands being evaluated. A crucial aspect of this method of controlling playback is that all music events in the music information file are actually processed, so that no skipping, crashing, or other application errors occur as a result of missed events. A missed event is a music event that has been skipped over entirely by simply jumping to a later note in the music information file. This would occur, for example, if a music event was started (e.g. a music instrument patch change, changing the sound from a piano sound to a violin sound), playback was skipped ahead to a later point in the music, and another music event (e.g., a music instrument patch change back from violin to piano) had occurred in the skipped portion of the music information file.

Figure 14:
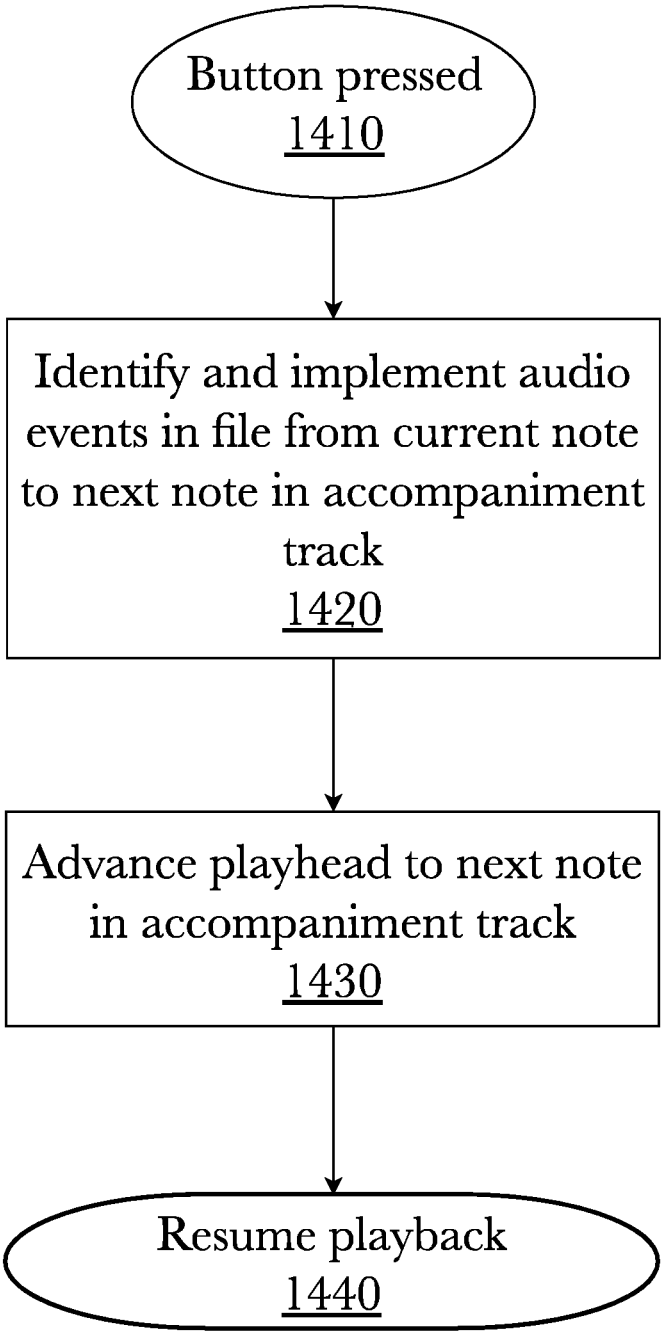
FIG. 14 is a flowchart illustrating the fermata start functionality of the fermata button, according to an aspect of an embodiment.

FIG. 14 is a flowchart illustrating the fermata start functionality of the fermata button, according to an aspect of an embodiment. While the audio accompaniment is not being played, the user may press and then release the fermata button, and have the music start playback at a pre-defined point immediately upon release of the fermata button. In an embodiment of this functionality, while playback of the music accompaniment is stopped, in addition to other functionality available, the user may create a new marker for playback, select a previously created marker, or choose not to create, set, store, or select a marker. The creation, setting, storing, or selection of a marker may be associated with a set marker button separate from the fermata button. When the fermata button is pressed 1410, the application identifies audio events (e.g., pedal commands) from the current note (i.e. playhead position, since music is stopped) up to the next note in the accompaniment track 1420, gathering and reporting every MIDI audio event up to that point, which audio events are then sent on a command channel directly to the MIDI engine which implements each such audio event in sequence. In this way, before the playback begins next, the audio events including lingering note sounds, pedal effects, distortion, and more, are all still represented as evaluating in a smooth continuation of the audio state prior to interruption by the fermata button, and there is no "choppiness" from pausing to unpausing with the fermata button, providing for smooth playback. After this evaluation, if no marker has been selected, the playhead is advanced to the next note in the accompaniment track 1430 after the point at which music playback was stopped, and playback continues at the tempo set prior to the fermata button press 1410. If a marker was created or selected, the playhead is advanced to the next note in the accompaniment track 1430 at or after the marker, and playback continues at the tempo set prior to the fermata button press 1410. Playback immediately resumes at the current location of the playhead 1440. Although this example shows the audio events/pedal commands being performed before advancement of the playhead, an alternate embodiment would have the playhead advanced first, and then the audio events/pedal commands being evaluated. A crucial aspect of this method of controlling playback is that all music events in the music information file are actually processed, so that no skipping, crashing, or other application errors occur as a result of missed events. A missed event is a music event that has been skipped over entirely by simply jumping to a later note in the music information file. This would occur, for example, if a music event was started (e.g. a music instrument patch change, changing the sound from a piano sound to a violin sound), playback was skipped ahead to a later point in the music, and another music event (e.g., a music instrument patch change back from violin to piano) had occurred in the skipped portion of the music information file.

Figure 15:
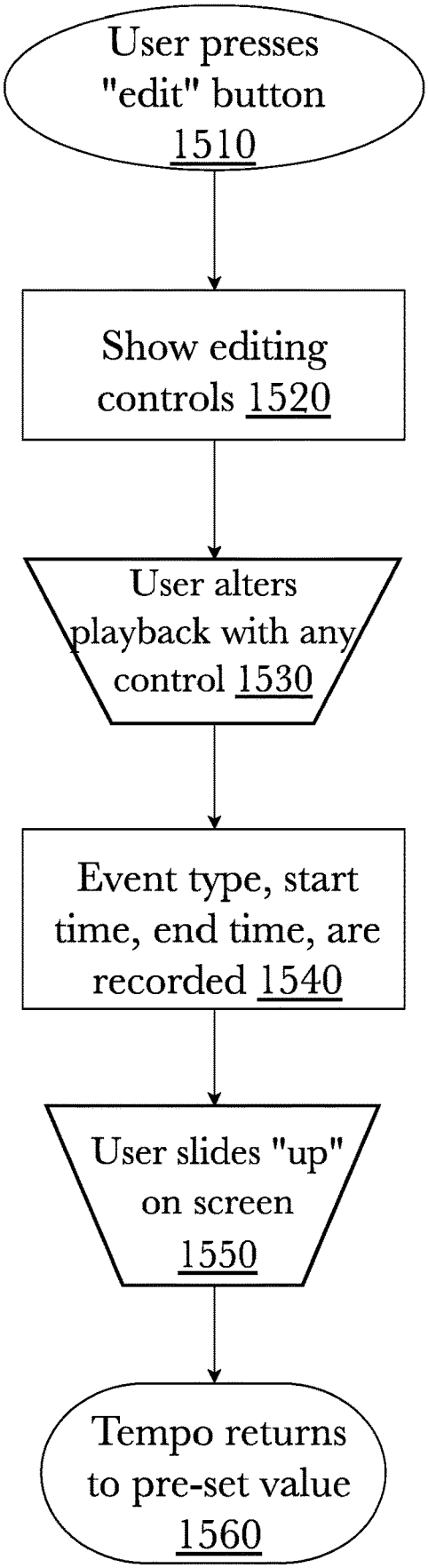
FIG. 15 is a flowchart illustrating the functionality of an editing control screen and preset tempo restoration gesture.

FIG. 15 is a flowchart illustrating the functionality of an editing control screen and preset tempo restoration gesture. A user may press an "edit controls" button 1510, which results in editing controls being displayed 1520 to a user, including a tempo slider, fermata control, the ability to place or navigate to markers in an accompaniment track, and so on. If a user uses a control to alter playback 1530, the event type, as well as start time and end time if applicable, are recorded 1540 as meta-data associated with the accompaniment track as customization of the track playback, for possible future use. Such meta-data may be stored in the music information file, if the format allows for it, or may be stored in a separate file. A user may also make a gesture on a touch-screen, sliding "up" 1550, resulting in the tempo of an accompaniment track being re-set to a pre-set speed 1560. Events may be recorded 1540 by creating an array of edit events in memory that are marked by event type, start time, and stop if applicable, such as for looping sections of a song. These events are recorded as the piece is played, and saved locally so they are persistent. The edit events are only active when the edit controls are shown.

Figure 16:
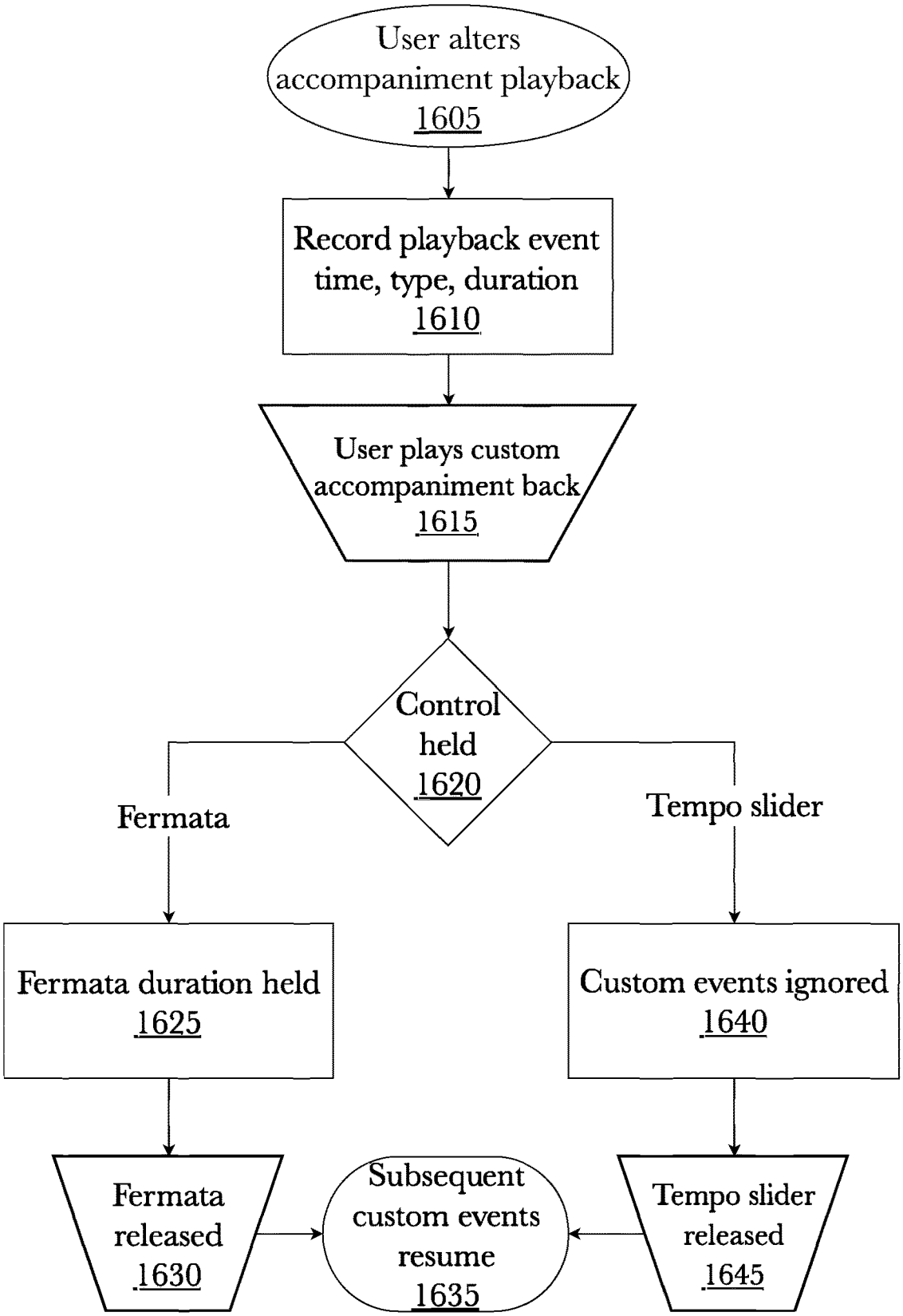
FIG. 16 is a flowchart illustrating the saving and controlling of playback of a custom accompaniment file.

FIG. 16 is a flowchart illustrating the saving and controlling of playback of a custom accompaniment file. A user may alter the playback of an accompaniment track 1605, with the type, time, and duration of each event being recorded 1610 as applicable, and during a custom accompaniment playback 1615, these events are replicated. During custom track playback 1615, if a control is held 1620, it is checked whether it is a fermata or tempo control. If it is a fermata control, the duration of a note may be held 1625, as shown in earlier embodiments, until the button and control are released 1630, resulting in subsequent events in the custom track resuming as normal 1635. If a tempo slider is utilized during custom accompaniment playback, events in the custom track are ignored 1640, resuming playback as normal except for involvement of the tempo slider, until the tempo slider is released 1645, at which time custom events resume normally during playback from that point 1635. Custom versions of accompaniments may be implemented by recording certain playback events 1610. The event time, type, and duration may be recorded. When playing a custom version the playback monitor replays these events as they appear in real time 1615. If the user taps and holds the tempo slider 1620 all custom version events are ignored as long as the tempo slider is held 1640. As soon as the tempo slider is let go 1645 of any custom events that subsequently appear in the timeline are played 1635.

Hardware Architecture

Generally, the techniques disclosed herein may be implemented on hardware or a combination of software and hardware. For example, they may be implemented in an operating system kernel, in a separate user process, in a library package bound into network applications, on a specially constructed machine, on an application-specific integrated circuit ("ASIC"), or on a network interface card.

Software/hardware hybrid implementations of at least some of the aspects disclosed herein may be implemented on a programmable network-resident machine (which should be understood to include intermittently connected network-aware machines) selectively activated or reconfigured by a computer program stored in memory. Such network devices may have multiple network interfaces that may be configured or designed to utilize different types of network communication protocols. A general architecture for some of these machines may be described herein in order to illustrate one or more exemplary means by which a given unit of functionality may be implemented. According to specific aspects, at least some of the features or functionalities of the various aspects disclosed herein may be implemented on one or more general-purpose computers associated with one or more networks, such as for example an end-user computer system, a client computer, a network server or other server system, a mobile computing device (e.g., tablet computing device, mobile phone, smartphone, laptop, or other appropriate computing device), a consumer electronic device, a music player, or any other suitable electronic device, router, switch, or other suitable device, or any combination thereof. In at least some aspects, at least some of the features or functionalities of the various aspects disclosed herein may be implemented in one or more virtualized computing environments (e.g., network computing clouds, virtual machines hosted on one or more physical computing machines, or other appropriate virtual environments).

Figure 6:
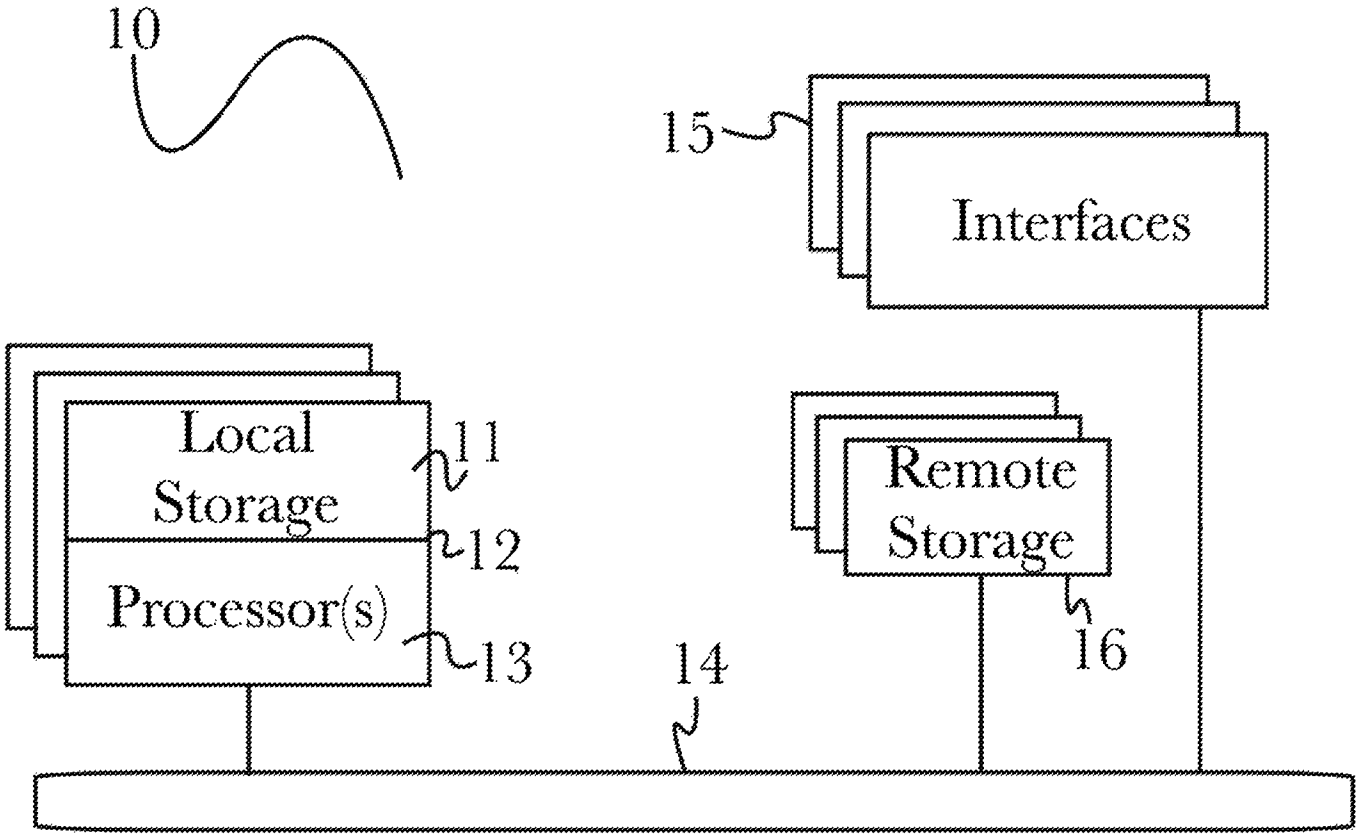
FIG. 6 is a block diagram illustrating an exemplary hardware architecture of a computing device.

Referring now to FIG. 6, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one embodiment, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one embodiment, a computing device 10 may be configured or designed to function as a server system utilizing CPU 12, local memory 11 and/or remote memory 16, and interface(s) 15. In at least one embodiment, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some embodiments, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a specific embodiment, a local memory 11 (such as non-volatile random access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one embodiment, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (WiFi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity AN hardware interfaces) and, in some instances, volatile and/or non-volatile memory (e.g., RAM).

Although the system shown in FIG. 6 illustrates one specific architecture for a computing device 10 for implementing one or more of the inventions described herein, it is by no means the only device architecture on which at least a portion of the features and techniques described herein may be implemented. For example, architectures having one or any number of processors 13 may be used, and such processors 13 may be present in a single device or distributed among any number of devices. In one embodiment, a single processor 13 handles communications as well as routing computations, while in other embodiments a separate dedicated communications processor may be provided. In various embodiments, different types of features or functionalities may be implemented in a system according to the invention that includes a client device (such as a tablet device or smartphone running client software) and server systems (such as a server system described in more detail below).

Regardless of network device configuration, the system of the present invention may employ one or more memories or memory modules (such as, for example, remote memory block 16 and local memory 11) configured to store data, program instructions for the general-purpose network operations, or other information relating to the functionality of the embodiments described herein (or any combinations of the above). Program instructions may control execution of or comprise an operating system and/or one or more applications, for example. Memory 16 or memories 11, 16 may also be configured to store data structures, configuration data, encryption data, historical system operations information, or any other specific or generic non-program information described herein.

Because such information and program instructions may be employed to implement one or more systems or methods described herein, at least some network device embodiments may include nontransitory machine-readable storage media, which, for example, may be configured or designed to store program instructions, state information, and the like for performing various operations described herein. Examples of such nontransitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

Figure 7:
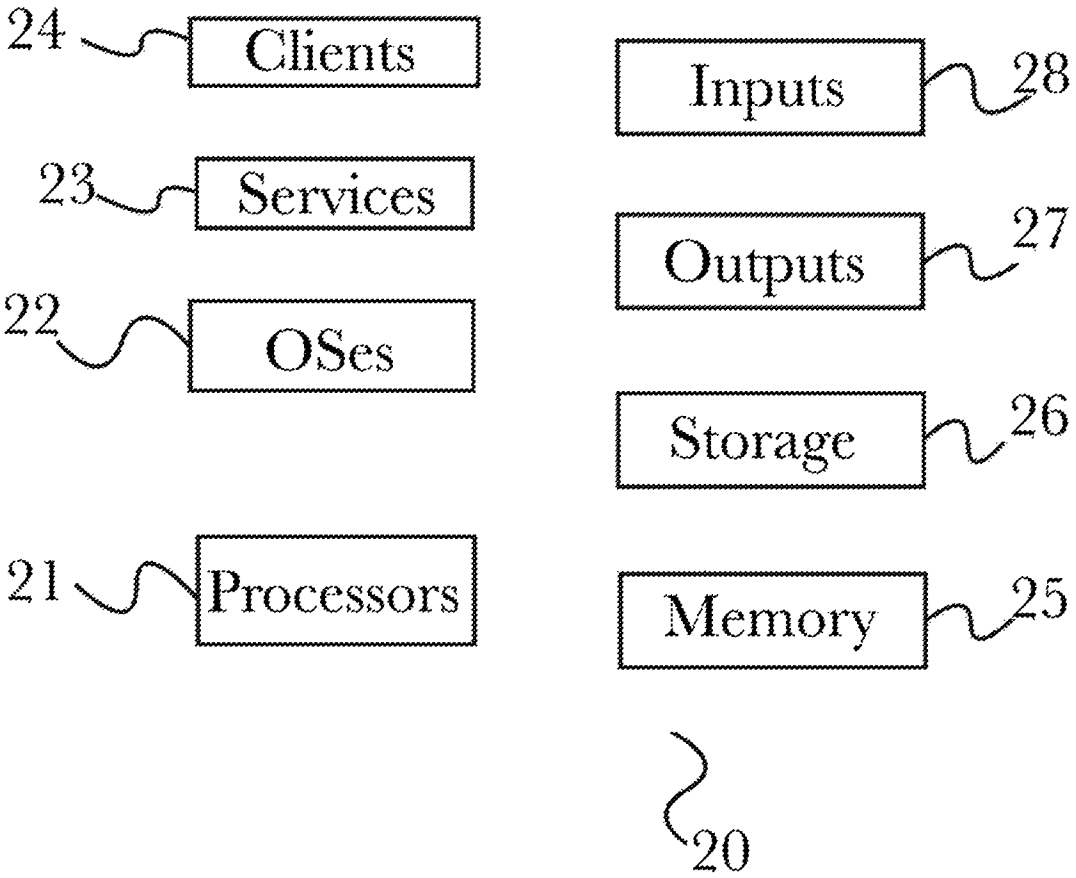
FIG. 7 is a block diagram illustrating an exemplary logical architecture for a client device.

In some embodiments, systems according to the present invention may be implemented on a standalone computing system. Referring now to FIG. 7, there is shown a block diagram depicting a typical exemplary architecture of one or more embodiments or components thereof on a standalone computing system. Computing device 20 includes processors 21 that may run software that carry out one or more functions or applications of embodiments of the invention, such as for example a client application 24. Processors 21 may carry out computing instructions under control of an operating system 22 such as, for example, a version of MICROSOFT WINDOWS™ operating system, APPLE OSX™ or iOS™ operating systems, some variety of the Linux operating system, ANDROID™ operating system, or the like. In many cases, one or more shared services 23 may be operable in system 20, and may be useful for providing common services to client applications 24. Services 23 may for example be WINDOWS™ services, user-space common services in a Linux environment, or any other type of common service architecture used with operating system 21. Input devices 28 may be of any type suitable for receiving user input, including for example a keyboard, touchscreen, microphone (for example, for voice input), mouse, touchpad, trackball, or any combination thereof. Output devices 27 may be of any type suitable for providing output to one or more users, whether remote or local to system 20, and may include for example one or more screens for visual output, speakers, printers, or any combination thereof. Memory 25 may be random-access memory having any structure and architecture known in the art, for use by processors 21, for example to run software. Storage devices 26 may be any magnetic, optical, mechanical, memristor, or electrical storage device for storage of data in digital form (such as those described above, referring to FIG. 6). Examples of storage devices 26 include flash memory, magnetic hard drive, CD-ROM, and/or the like.

Figure 8:
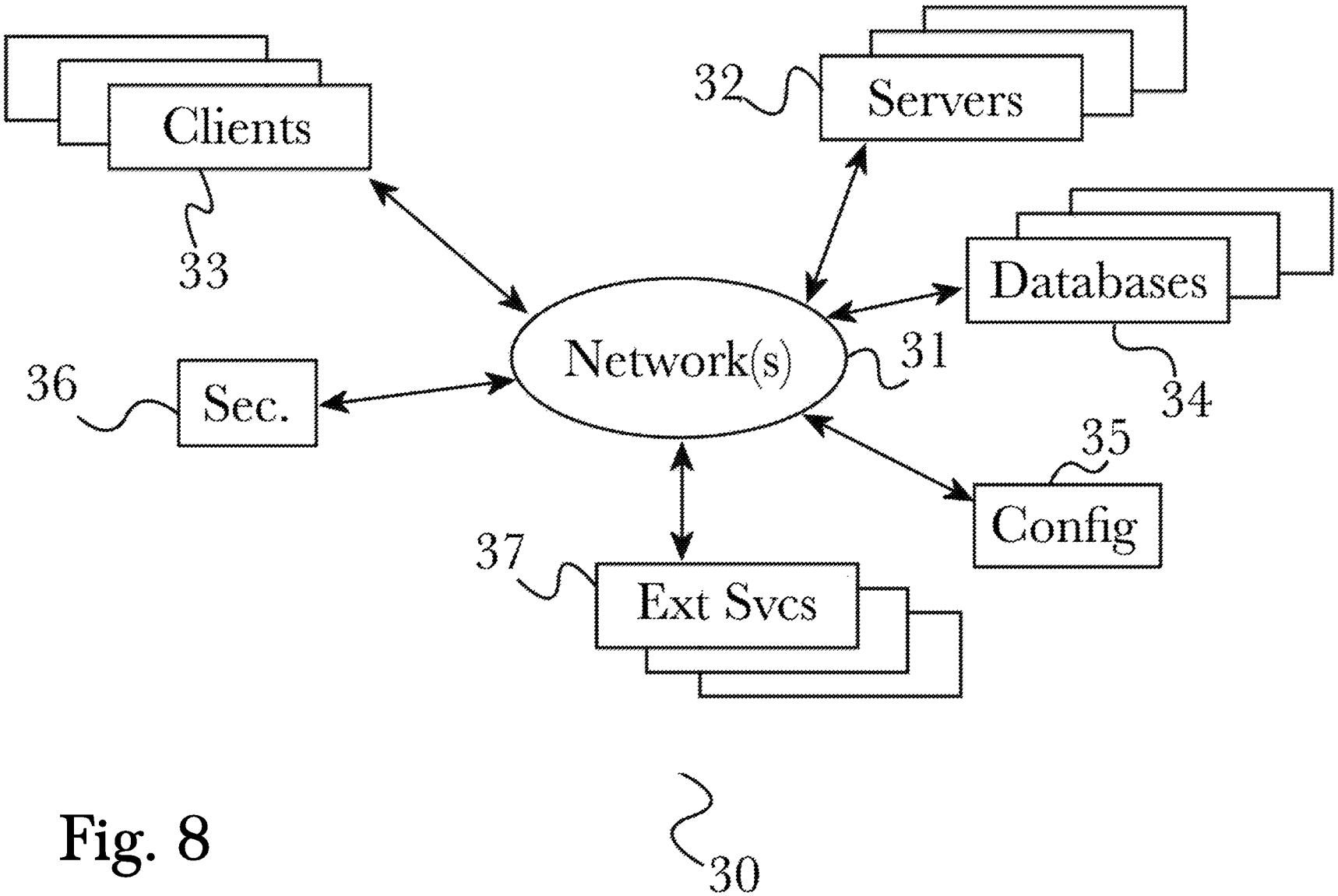
FIG. 8 is a block diagram showing an exemplary architectural arrangement of clients, servers, and external services.

In some embodiments, systems of the present invention may be implemented on a distributed computing network, such as one having any number of clients and/or servers. Referring now to FIG. 8, there is shown a block diagram depicting an exemplary architecture 30 for implementing at least a portion of a system according to an embodiment of the invention on a distributed computing network. According to the embodiment, any number of clients 33 may be provided. Each client 33 may run software for implementing client-side portions of the present invention; clients may comprise a system 20 such as that illustrated in FIG. 7. In addition, any number of servers 32 may be provided for handling requests received from one or more clients 33. Clients 33 and servers 32 may communicate with one another via one or more electronic networks 31, which may be in various embodiments any of the Internet, a wide area network, a mobile telephony network (such as CDMA or GSM cellular networks), a wireless network (such as WiFi, WiMAX, LTE, and so forth), or a local area network (or indeed any network topology known in the art; the invention does not prefer any one network topology over any other). Networks 31 may be implemented using any known network protocols, including for example wired and/or wireless protocols.

In addition, in some embodiments, servers 32 may call external services 37 when needed to obtain additional information, or to refer to additional data concerning a particular call. Communications with external services 37 may take place, for example, via one or more networks 31. In various embodiments, external services 37 may comprise web-enabled services or functionality related to or installed on the hardware device itself. For example, in an embodiment where client applications 24 are implemented on a smartphone or other electronic device, client applications 24 may obtain information stored in a server system 32 in the cloud or on an external service 37 deployed on one or more of a particular enterprise's or user's premises.

In some embodiments of the invention, clients 33 or servers 32 (or both) may make use of one or more specialized services or appliances that may be deployed locally or remotely across one or more networks 31. For example, one or more databases 34 may be used or referred to by one or more embodiments of the invention. It should be understood by one having ordinary skill in the art that databases 34 may be arranged in a wide variety of architectures and using a wide variety of data access and manipulation means. For example, in various embodiments one or more databases 34 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In some embodiments, variant database architectures such as column-oriented databases, in-memory databases, clustered databases, distributed databases, or even flat file data repositories may be used according to the invention. It will be appreciated by one having ordinary skill in the art that any combination of known or future database technologies may be used as appropriate, unless a specific database technology or a specific arrangement of components is specified for a particular embodiment herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, most embodiments of the invention may make use of one or more security systems 36 and configuration systems 35. Security and configuration management are common information technology (IT) and web functions, and some amount of each are generally associated with any IT or web systems. It should be understood by one having ordinary skill in the art that any configuration or security subsystems known in the art now or in the future may be used in conjunction with embodiments of the invention without limitation, unless a specific security 36 or configuration system 35 or approach is specifically required by the description of any specific embodiment.

Figure 9:
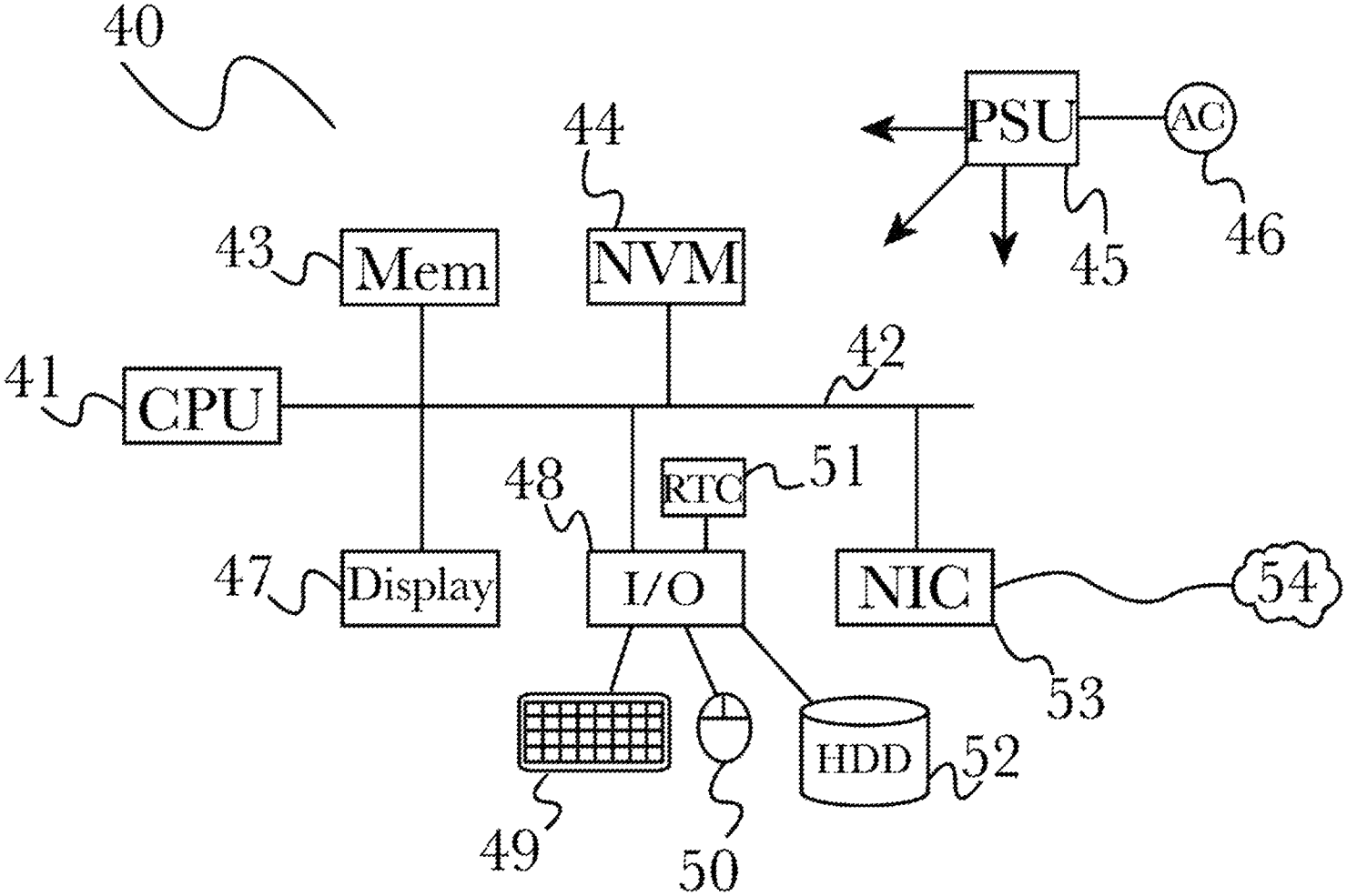
FIG. 9 is another block diagram illustrating an exemplary hardware architecture of a computing device.

FIG. 9 shows an exemplary overview of a computer system 40 as may be used in any of the various locations throughout the system. It is exemplary of any computer that may execute code to process data. Various modifications and changes may be made to computer system 40 without departing from the broader scope of the system and method disclosed herein. Central processor unit (CPU) 41 is connected to bus 42, to which bus is also connected memory 43, nonvolatile memory 44, display 47, input/output (I/O) unit 48, and network interface card (NIC) 53. I/O unit 48 may, typically, be connected to keyboard 49, pointing device 50, hard disk 52, and real-time clock 51. NIC 53 connects to network 54, which may be the Internet or a local network, which local network may or may not have connections to the Internet. Also shown as part of system 40 is power supply unit 45 connected, in this example, to a main alternating current (AC) supply 46. Not shown are batteries that could be present, and many other devices and modifications that are well known but are not applicable to the specific novel functions of the current system and method disclosed herein. It should be appreciated that some or all components illustrated may be combined, such as in various integrated applications, for example Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices).

In various embodiments, functionality for implementing systems or methods of the present invention may be distributed among any number of client and/or server components. For example, various software modules may be implemented for performing various functions in connection with the present invention, and such modules may be variously implemented to run on server and/or client components.

The skilled person will be aware of a range of possible modifications of the various embodiments described above. Accordingly, the present invention is defined by the claims and their equivalents.

What is claimed is:

1. A system for delivering user-controlled musical accompaniments, comprising:

an accompaniment application comprising at least first plurality of programming instructions stored in a first memory and operating on a first processor, wherein the first plurality of programming instructions, when operating on the first processor, cause the first processor to:

receive accompaniment music in music information format comprising musical notes and a first tempo;

allow a user to initiate a first playback of the accompaniment music at the first tempo using a graphical user interface;

provide one or more controls on the graphical user interface for the user to control one or more aspects of the playback of the accompaniment music in real time;

wherein the one or more controls comprise a fermata button which, when pressed during playback of the accompaniment music, causes the first processor to:

set a second music tempo to at most $1/10^{th}$ of the first tempo;

continue to sound currently audible notes at the second music tempo while the fermata button is being held; and wherein the release of the fermata button causes the processor to:

identify all audio events in the accompaniment music from the current play position to the next note in the accompaniment track;

implement each identified audio event in sequence;

resume playback at the next note in the accompaniment track at the first tempo.

2. The system of claim 1, wherein the one or more controls further comprise a set marker button which, when pressed, causes the processor to:

record a location in the accompaniment music at which a marker should be set; and store a marker indicating that location.

3. The system of claim 2, wherein the fermata button, when pressed and then released while the accompaniment music is stopped, causes the processor to:

identify all audio events in the accompaniment music from the current play position to the next note in the accompaniment track;

implement each identified audio event in sequence; and start playback at the next note in the accompaniment track.

4. The system of claim 1, wherein the one or more controls further comprise a tempo slider which, when moved, causes the processor to:

set a third music tempo to a value indicated on the tempo slider;

continue playback of the accompaniment music at the third tempo, until the third tempo is canceled by the user; and resume playback of the accompaniment music at the first tempo when the third tempo is canceled by the user.

5. The system of claim 1, wherein the accompaniment application further allows the user to create customized versions of the accompaniment music by:

saving playback alterations to the accompaniment music made by the user;

allowing the user to play back a customized version of the accompaniment music file, comprising the accompaniment music as altered by the playback alterations; and allowing the user to override the playback alterations during playback of the customized version of the accompaniment music by using the one or more controls on the graphical user interface.

6. The system of claim 1, further comprising a cloud service engine comprising at least a second processor, a second memory, and a second plurality of programming instructions stored in the second memory and operating on the second processor, wherein the second programming instructions, when operating on the second processor, cause the second processor to:

communicate with the accompaniment application;

send to, and receive from, the accompaniment application data comprising accompaniment music and playback alterations to the accompaniment music;

display, and allow selection of, stored files by the accompaniment application;

display, and allow selection of, privacy settings for files uploaded by the accompaniment application; and allow sharing of, or sale of, files to other instances of the accompaniment application owned by other users.

7. The system of claim 1, wherein peripheral devices are used instead of, or in addition to, one or more of the controls on the graphical user interface to control playback of the accompaniment music.

8. The system of claim 1, wherein the one or more controls further comprise a melody blend slider which, when moved, causes the processor to:

select a melody track within the accompaniment music; and and adjust the relative volume of the melody track and volume of the accompaniment music without stopping playback of the accompaniment music.

9. A method for delivering user-controlled musical accompaniments, comprising the steps of:

receiving accompaniment music in music information format comprising musical notes;

allowing a user to initiate a first playback of the accompaniment music at a first tempo using a graphical user interface;

providing one or more controls on the graphical user interface for the user to control one or more aspects of the playback of the accompaniment music in real time;

wherein the one or more controls comprise a fermata button which, when pressed, causes a device playing back the accompaniment music to:

set a second music tempo to at most $1/10^{th}$ of the first tempo;

continue to sound currently audible notes at the second music tempo while the fermata button is being held; and wherein the release of the fermata button causes the device playing back the accompaniment music to:

identify all audio events in the accompaniment music from the current play position to the next note in the accompaniment track;

implement each identified audio event in sequence;

resume playback at a next note in the accompaniment track at the first tempo.

10. The method of claim 9, wherein the one or more controls further comprise a set marker button which, when pressed, causes the processor to:

record a location in the accompaniment music at which a marker should be set; and store a marker indicating that location.

11. The method of claim 10, wherein the fermata button, when pressed and released while the accompaniment music is stopped, causes the processor to:

identify all audio events in the accompaniment music up to the current playhead position;

implement each identified audio event in sequence; and resume playback at the next note in the accompaniment track following the current playhead position at the first tempo.

12. The method of claim 9, wherein the one or more controls further comprise a tempo slider which, when moved, causes the device playing back the accompaniment music to:

set a third music tempo to a value indicated on the tempo slider;

continue playback of the accompaniment music at the third tempo, until the third tempo is canceled by the user; and resume playback of the accompaniment music at the first tempo when the third tempo is canceled by the user.

13. The method of claim 9, comprising the further step of allowing the user to create customized versions of the accompaniment music by:

saving playback alterations to the accompaniment music made by the user;

allowing the user to play back a customized version of the accompaniment music file, comprising the accompaniment music as altered by the playback alterations; and allowing a user to override the playback alterations during playback of the customized version of the accompaniment music by using the one or more controls on the graphical user interface.

14. The method of claim 9, further comprising the steps of:

communicating with the accompaniment application;

sending to, and receiving from, the accompaniment application data comprising accompaniment music and playback alterations to the accompaniment music;

displaying, and allowing selection of, stored files by the accompaniment application;

displaying, and allowing selection of, privacy settings for files uploaded by the accompaniment application; and allowing sharing of, or sale of, files to other instances of the accompaniment application owned by other users.

15. The method of claim 9, further comprising the step of using peripheral devices instead of, or in addition to, one or more of the controls on the graphical user interface to control playback of the accompaniment music.

16. The method of claim 9, further comprising the step of using a melody blend slider to:

select a melody track within the accompaniment music; and adjust the volume of the melody track relative to the volume of the accompaniment music without stopping playback of the accompaniment music.

* * * * *